United States Patent [19]

Rech et al.

[11] 4,203,050

[45] May 13, 1980

[54] GAS DISCHARGE LAMP AND METHOD

[75] Inventors: Werner Rech, Taunusstein; Wolfgang Welsch, Wiesbaden; Eugen Achter, Astheim, all of Fed. Rep. of Germany

[73] Assignee: Heimann GmbH, Fed. Rep. of Germany

[21] Appl. No.: 922,797

[22] Filed: Jul. 7, 1978

[30] Foreign Application Priority Data

Jul. 28, 1977 [DE] Fed. Rep. of Germany ..... 2734099

[51] Int. Cl.[2] ..... H01J 61/30

[52] U.S. Cl. ..... 313/220; 29/25.13

[58] Field of Search ..... 313/220; 29/25.13

[56] References Cited

U.S. PATENT DOCUMENTS 3,450,924 6/1969 Knochel et al. ..... 313/220

FOREIGN PATENT DOCUMENTS 748625 4/1944 Fed. Rep. of Germany .
2332588 10/1976 Fed. Rep. of Germany .
2641880 3/1977 Fed. Rep. of Germany .
1764299 7/1977 Fed. Rep. of Germany .
1178091 1/1970 United Kingdom .
1513700 6/1978 United Kingdom .

OTHER PUBLICATIONS

"Philips Technical Review", vol. 22, No. 12, pp. 377–404, Sep. 11, 1964.

*Primary Examiner*—James B. Mullins
*Assistant Examiner*—Darwin R. Hostetter
*Attorney, Agent, or Firm*—Hill, Van Santen, Steadman, Chiara & Simpson

[57] ABSTRACT

A gas discharge lamp, particularly useful as a flash tube, has a glass tube and electrode feed-through conductors which are connected with the glass tube in gas-tight relationship via glass members and glass solder. The glass members consist of prefabricated shaped parts having a geometry which absorbs thermal stresses between the glass members and the glass tube.

10 Claims, 3 Drawing Figures

GAS DISCHARGE LAMP AND METHOD

BACKGROUND

1. Field of the Invention

The present invention relates to a gas discharge lamp, having two electrodes which are connected in gas-tight relationship to the ends of a glass tube, and particularly to such a tube which is used as a flash lamp.

2. The Prior Art

Gas discharge lamps are known, for example, from Philips Technical Review, September 1961, pages 377–404. Such a gas discharge lamp or flash tube consists of a piece of glass tube into which an electrode is placed at each end, in gas-tight relationship with the tube. Typically, the anode consists of tungsten or molybdenum and the cathode consists of a sintered member impregnated with emitting material and getter material, as described, for example, in the German Auslegeschrift 23 32 588. A noble gas such as xenon is typically used to fill the space within the tube. Sometimes an ignition electrode, attached to the exterior, is used to initiate the gas discharge by at least partially ionizing the gas within the tube. The discharge begins at the cathode and spreads toward the anode until the field intensity between the cathode and anode ionizes the space between the cathode and anode and permits the main gas discharge to take place. A gas discharge can also be introduced without an ignition electrode, if a voltage pulse of sufficient magnitude is supplied between the anode and cathode.

Because of the required heat-carrying capacity of the tube, and the need for transparency and electrical insulation, the glass tube typically consists of quartz glass or of a hardened glass such as Pyrex, having a very high melting point, and is preferably formed of borosilicate glass. The metallic feed-through lines which are sealed in gas-tight relationship with the ends of the tube, and which are connected to the electrodes, must be selected so that thermal expansion of the feed-through lines and/or the glass tube does not result in loss of the gas-tight relationship. When hardened glass such as Pyrex is used for the glass tube, tungsten may be used for the electrodes, or at least for the feed-through lines. Glasses which are adapted to the thermal expansion coefficient of tungsten are available in the trade. Quartz glass, however, and some hardened glasses cannot be adapted for use with a tungsten feed-through conductor. When quartz glass or some hardened glasses are used for the glass tube, a connecting piece of intermediate glass must be provided in order to adapt the different thermal expansion coefficients of the quartz or hardened glass and feed-through conductors. When a connecting piece is used, the feed-through conductors may be formed of relatively inexpensive nickel iron instead of the relatively more expensive tungsten.

When a connecting piece is used, it is formed by processing molten glass, such as by melting a glass tube formed of the connecting material onto a feed-through line, or coating the feed-through line by applying the material in melted condition, and assembling the parts with the glass tube by a glass-melting operation. In either case, expensive process steps are required, and the glass materials must be melted at the connecting points in order to obtain a gas-tight connection. In the performance of these processes, not only is a relatively high quantity of energy required, but glass breakage can readily occur, as well as thermally induced stresses within the glass, which can impair the life-span of the gas discharge lamp. Also, when the above-described processes are practiced, it is difficult to control the pressure of the gas within the discharge tube, and it is difficult to closely control the inner electrode spacing within the gas tube.

The disadvantages involved in the use of connecting pieces as described above are overcome by using sintered glass members for sealing the ends of the glass tube.

The sintered glass members can be machine-produced very inexpensively, and their utilization in place of the previously used glass connecting members makes it unnecessary to perform expensive glass-blowing operations during assembly. The precise dimensions of the sintered glass members may be readily controlled, and the feed-through conductors which support the electrodes of the gas discharge lamp are melted into the sintered glass members as they are formed. It is possible to maintain precise spacing of the electrodes of the gas discharge lamp, during assembly, when the sintered glass members are connected to the tubular wall of the lamp. Since the operating life of the lamp, and the light intensity produced thereby, is a function of the electrode spacing, these factors can be controlled quite closely through the use of tubes for the gas discharge lamp which have previously determined fixed lengths, so that there is no waste of the glass material of which the tube is formed, during sealing of the sintered members during assembly of the tube.

SUMMARY OF THE INVENTION

It is a principal object of the present invention to provide a gas discharge lamp construction in which the thermal characteristics of the parts have no affect on the maintenance of the gas-tight relationship between the glass tube and the feed-through conductors.

In one embodiment of the present invention, the feed-through conductors for the electrodes of the gas discharge lamp extend through shaped parts formed of glass having a thermal expansion coefficient which is essentially the same as that of the feed-through conductor. The shaped parts seal the ends of the tube of the gas discharge lamp at their frontal surfaces with glass solder, and are constructed with a form such that mechanical stresses resulting from different thermal expansion coefficients between the shaped parts and the glass tube do not impair the gas-tight relationship between the shaped parts and the glass tube, or the gas-tight relationship between the shaped parts and the feed-through conductors.

The shaped parts of the present invention have an essentially cone-shaped portion which projects into the interior of the discharge tube. Because of this construction, mechanical stresses in a radial direction have only small affect at the point at which the gas discharge tube is joined to the shaped part. Such stresses have a negligible effect on the connection between the shaped part and the feed-through conductor, because such stresses are distributed before they reach the interface between the shaped part and the feed-through conductor. The conical shape of the shaped part permits the centering of the electrodes inside the tube, and also prevents glass solder from flowing into the interior of the discharge tube during the glass soldering step.

In another embodiment of the present invention, the cone-shaped portion of the shaped part terminates in a disk-shaped part having a ring-shaped edge facing the end of the discharge tube, which is used as a solder surface area. The transition between the cone-shaped part and the disk-shaped part may be formed in the shape of a concave groove or channel.

The shaped parts of the present invention are produced in a way which is simpler than the production of the sintered glass members referred to above. In one method of production, a glass capillary piece is slipped onto a feed-through conductor. This is accomplished readily by means of a jarring table, so that the assembly of the capillary pieces and the feed-through conductors is virtually automatic. The assembled capillary piece, with its feed-through conductor, is then heat-treated in a carbon form, from which the glass capillary piece receives its final shape and is simultaneously melted to the feed-through conductor in gas-tight relationship. In this way the mass production of shaped parts, with the feed-through conductors and/or electrodes in place is readily achieved. The shaped parts are easily connected to the ends of the preformed glass tubes by the use of a solder ring formed of glass, so that neither the glass of the shaped part nor the glass of the tube end need be melted.

Additional objects and advantages of the present invention will become manifest by an inspection of the accompanying drawings and the following description.

BRIEF DESCRIPTION OF THE DRAWINGS

Reference will now be made to the accompanying drawings in which.

DESCRIPTION OF THE PREFERRED EMBODIMENTS

Figure 1:
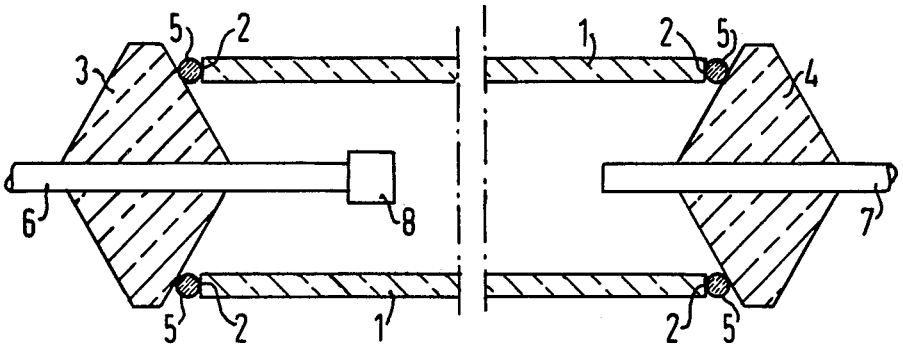
FIG. 1 is a longitudinal cross sectional view of one embodiment of the present invention.

Referring now to FIG. 1, a tube 1 consisting of transparent borosilicate glass or quartz has a circular cross section. At its ends, it has circular frontal surfaces 2 to which shaped parts 3 and 4 are soldered by means of glass solder rings 5. The shaped parts 3 and 4 have circular cross sections with the thickest part being approximately the same diameter as the outer diameter of the tube 1. The shaped parts 3 and 4 each have a cone-shaped portion projecting into the interior of the glass tube, and the reverse surfaces of the shaped parts 3 and 4 are also conical in shape. The shaped part 3 supports the feed-through conductor 6 which supports the cathode 8, and an anode 7 is supported by the shaped part 4. In the case of the anode 7, the anode forms its own feed-through conductor.

The axial length of both of the shaped parts 3 and 4 are between two to ten times the diameter of the feed-through conductors, to insure a gas-tight relationship between the feed-through conductors and the shaped parts. This also insures sufficient mechanical strength for the completed assembly. The cathode 8 is preferably formed of a sintered member.

The feed-through conductors 6 and 7 are preferably formed of molybdenum or a nickel iron cobalt alloy (Ni-Fe-Co-alloy) having a thermal expansion coefficient of about 5.1 or 5.2, between 20° C. and 300° C. The shaped parts 3 and 4 are formed of a glass having a thermal expansion coefficient of about 5 over the same range of temperatures. The glass solder, of which the ring 5 is formed, has a thermal expansion coefficient of about 4.5 over the same temperature range. The glass of the tube 1 has a thermal expansion coefficient of about 4.1 over the same range. In spite of the different expansion coefficients of these parts, thermal stresses are distributed by the geometry of the shaped parts 3 and 4 so that the completed assembly remains mechanically stable and gas-tight.

Figure 2:
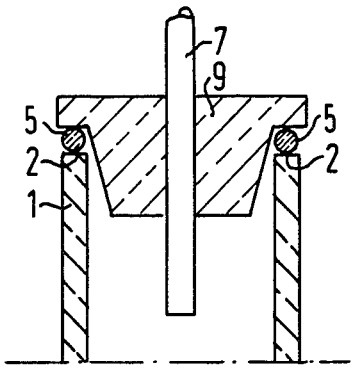
FIGS. 2 and 3 are longitudinal cross sectional views, in fragmentary form, of two alternative embodiments of the present invention.

Referring to FIG. 2, an alternative embodiment of the present invention is illustrated, employing a shaped part 9, which has a plane surface on its side facing away from the glass tube 1. It has an annular shoulder 10 facing the end surface 2 of the glass tube 1, and these surfaces are soldered together by means of the solder ring 5. The geometry of the shaped part 9 may be described as having a conical section which projects into the tube 1, with the exterior end thereof formed as a disk or a flange. The interior of the projecting conical portion of the shaped part 9 is truncated.

Figure 3:
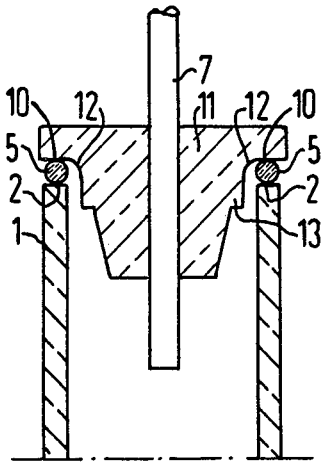

Another alternative embodiment is illustrated in FIG. 3. There a shaped part 11 is provided which is similar in shape to the shaped part 9 of FIG. 2, except that a ring-shaped groove 12 is formed between the shoulder 10 and the conical portion of the shaped part. The dimension of the groove 12 is large enough so that it is not filled with glass solder during the assembly of the parts. An annular projection 13 which is positioned between the groove 12 and the conically extending portion of the part 11 allows improved centering of the shaped part 11 during assembly with the tube 1. In the arrangement shown in FIG. 3, the radially exterior surface of the projection 13 is a circular cylinder, and during and after assembly, is coaxial with the tube 1.

From the above description, it is apparent that an economical gas discharge lamp construction is provided which does not require that the glass tube 1 have the identical thermal expansion coefficient as the shaped parts, and it is not necessary that the shaped parts have the same thermal expansion coefficient as the feed-through conductors. It is desirable that the thermal expansion coefficient of the shaped part be approximately the same as, but not greater than, the thermal expansion coefficient of the feed-through conductors. This insures an effective and long-lasting seal, even in the presence of relatively high-thermal loading such as is caused by repeated high-energy flashes of the gas discharge tube.

It will be apparent that various additions and modifications may be made in the apparatus and method of the present invention without departing from the essential features of novelty thereof, which are intended to be defined and secured by the appended claims.

What we claim is:

1. A gas discharge lamp having a glass tube and at least two feed-through conductors, each of said feed-through conductors being connected in gas-tight relationship with said glass tube at the ends of said tube through a sealing part formed of glass, said sealing parts each having a conically tapered section extending into the interior of said glass tube, and a glass solder ring interposed between each of said shaped parts and an end surface of said glass tube for sealing said sealing parts in gas-tight relationship to said glass tube, said glass solder ring compensating for mechanical stresses brought about by different thermal expansion coefficients of the sealing parts and the glass tube.

2. The gas discharge lamp according to claim 1, wherein one of said glass sealing rings is interposed between an end surface of said tube and a conically tapered surface of its sealing part.

3. The gas discharge lamp according to claim 1, in which one of said sealing parts is provided with an annular peripheral groove, and wherein said glass solder ring is interposed between said glass tube and said groove.

4. The gas discharge lamp according to claim 3, wherein said sealing part has an annular projection between said conical portion and said annular groove.

5. The gas discharge lamp according to claim 3, wherein said annular groove is spaced radially inwardly from the interior surface of said tube.

6. A method of producing a gas discharge lamp having a glass tube and at least two electrodes, said electrodes having feed-through conductors connected in gas-tight relationship with said tube, comprising the steps of assembling each of the feed-through conductors in fixed relationship with a sealing part, forming said sealing part of glass with a conically tapered portion, assembling said sealing part with said glass tube with said conically tapered portion extending into said glass tube, and sealing said sealing part in gas-tight relationship with an end surface of said tube with a glass solder ring interposed between said end surface and said sealing part.

7. The method according to claim 6, including the step of sealing said end surface of said glass tube to said conically tapered portion of said sealing part.

8. The method according to claim 6, including the steps of forming said sealing parts with a flange portion at the side of said conical surface facing away from said tube, and soldering said flange portion to said tube.

9. The method according to claim 8, including the step of forming an annular groove in said sealing part between said conical surface and said flange portion.

10. The method according to claim 9, including the step of forming an annular projection on said sealing part between said conical surface and said annular groove.

* * * * *